US005707143A

United States Patent [19]

Hentz

[11] Patent Number: 5,707,143

[45] Date of Patent: Jan. 13, 1998

[54] PULL-ON CLIP FOR DOWNLIGHT REFLECTOR TRIM

[75] Inventor: Joseph A. Hentz, Crawfordsville, Ind.

[73] Assignee: National Service Industries, Inc., Atlanta, Ga.

[21] Appl. No.: 707,004

[22] Filed: Sep. 3, 1996

[51] Int. Cl.[6] ..... F21S 1/02

[52] U.S. Cl. ..... 362/365; 362/147; 362/364; 362/396

[58] Field of Search ..... 362/364, 365, 362/147, 396, 404

[56] References Cited

U.S. PATENT DOCUMENTS

| | | | |
|---|---|---|---|
| 4,388,679 | 6/1983 | Blaisdell et al. | 362/396 |
| 4,593,344 | 6/1986 | Basile | 362/396 |
| 5,440,471 | 8/1995 | Zadeh | 362/365 |

*Primary Examiner*—Thomas M. Sember

*Attorney, Agent, or Firm*—Kenneth E. Darnell

[57] ABSTRACT

A pull-on clip manually assembled to a downlighting reflector trim in a snap-fastening manner without the need for tools, the invention mounts the reflector trim and a socket/spring clip assembly snap-fastened onto the trim within the interior of a lamp housing or can particularly in a downlighting fixture. The pull-on clip facilitates lamp positioning within the can and thereby within the fixture such that optimum lamp performance is obtained. The structure of the pull-on clip further facilitates the snug positioning of the reflector trim about a ceiling hole above which the downlighting fixture utilizing said clip is mounted for operation, thereby providing a clean appearance and positive lamp positioning.

20 Claims, 4 Drawing Sheets

PULL-ON CLIP FOR DOWNLIGHT REFLECTOR TRIM

BACKGROUND OF THE INVENTION

1. Field of the Invention

The invention relates generally to mounting structure for positioning and holding a reflector trim within a lamp housing of a downlighting fixture or similar lighting fixture, the invention particularly relating to an inexpensive pull-on clip which can be rapidly assembled onto a reflector trim for mounting said trim within such a lamp housing.

2. Description of the Prior Art

Downlighting provides a flexibility not available with most other categories of lighting due to the ability to employ a variety of fixtures intended for downlight purposes to lighting situations which range from ambient to accent to wall washing and the like. Where desired, downlighting can also be used in task lighting applications. The flexibility of downlighting is not limited to the use situation but also extends to appearance and even to the use of a variety of differing lamping choices in most downlighting fixtures. With costs always a consideration in any lighting choice, it becomes necessary to provide downlighting fixtures which can be inexpensively manufactured and installed with the least intensive labor use while providing the most optimal light performance possible. Lighting fixtures so configured must also be easily and rapidly installable not only by relatively skilled labor such as in new construction but also by relatively unskilled labor such as by a homeowner in a retrofit situation. Downlighting fixtures comprising varying "rough-in" structures are common in the marketplace and vary in complexity and cost. Such fixtures are manufactured and marketed by Lithonia Lighting, Inc. of Crawfordsville, Ind., Lithonia Lighting, Inc. being a division of National Service Industries, Inc. of Atlanta, Ga. In these fixtures as in downlighting fixtures produced by others, an intent has been the manufacture of effective fixtures having the best possible performance at the least possible fixture cost and the least possible involvement of installation labor. Fixtures having these desirable characteristics must include structure insertible into a lamp housing or "can" and which will positively secure lamping, a reflector trim with or without a baffle and a lamp socket within the can with positive lamp positioning and with positioning of the reflector trim snugly against a ceiling hole such that a gap does not exist between the trim and peripheral edge portions of the ceiling which surround the ceiling hole. While relatively complex and expensive mechanisms can and are employed in at least some downlighting fixtures to produce the necessary results, the achievement of such results inexpensively and with mechanical simplicity is less than commonplace in the industry. Desirable mechanical simplicity in the industry now extends even to the very insertion of a reflector trim and lamp socket assembly into the can, standard practices in the industry essentially requiring the ability to insert such an assembly into the can in a single motion with concurrent fitting of annular flange-like portions of the trim about the ceiling hole above which the fixture is operatively mounted. In the prior art, clip-like structures riveted to the reflector trim have been used to hold trim and socket assemblies within a can. These prior clip structures have required assembly to trim reflectors in a manufacturing environment and could not be reasonably attached on the job site. Clip attachment to reflector trim in the manufacturing environment further causes shipment of trim to a job site to be inefficient due to the bulky nature of reflector trim having preattached assembly clips, such trim being incapable of packaging in a nesting relation to each other such as will be possible if clips could be installed easily and rapidly on the job site. The industry has thus experienced a long-felt need for an improved mechanism for mounting a reflector trim or a reflector trim and lamp socket assembly within a lamp housing or can to achieve the results and economies alluded to herein.

The present invention intends solution to the deficiencies of the prior art by providing a reflector trim assembly which can also include a lamp socket mountable to the trim and which can be easily and rapidly mounted within the interior of a lamp housing or can of a downlighting fixture or similar lighting fixture. The invention includes assembly clip structure capable of attachment to a reflector trim on a job site without the use of tools, thereby allowing reflector trim to be compactly packaged in a nesting arrangement for shipment to the job site. The invention further allows positive retention of the reflector trim and any associated structure within the can with positive lamp positioning for optimal lighting performance and with snug fitting of the trim against a ceiling surface about a ceiling hole through which light is directed from the down-lighting fixture. The structure of the invention acts to "snug" the reflector trim against the ceiling to prevent an unsightly gap from existing between the trim and the ceiling, thus preventing light leakage and providing a clean appearance. The advantages of the invention are realized with net cost reductions in manufacture, product shipment and job-site installation.

SUMMARY OF THE INVENTION

The invention provides a clip structure for mounting of a reflector trim and any associated structure within a lamp socket of a downlighting fixture "rough-in". The clip can be easily and quickly pulled onto a penultimate body portion of a reflector trim and locked thereto by means of a fitting of a locking tab of the clip into an aperture formed in the reflector trim, the clip thus being positively secured to the reflector trim. Two of the "pull-on" clips are mounted one each to each side of the trim although it is to be understood that more than two of the clips could be used. Regardless of the number of clips used, the clips would be regularly spaced about upper portions of the reflector trim and attachable thereto without the use of tools. The structure of the present clips allows attachment thereof to the reflector trim at a job site, thereby allowing reflector trim to be compactly packaged and shipped to the job site with optimum economy. Use of the present pull-on clips provide positive lamp positioning on single motion insertion of a reflector trim assembly into a lamp housing or can with improved fitting of a trim flange of the reflector trim assembly against ceiling surfaces to provide a clean appearance and to prevent light leakage.

The pull-on clip of the invention is formed of spring steel having a thickness of approximately 0.02 inch in order to provide desired resiliency. The clip is further provided with a bend formed essentially medially of its length in order to provide the capability of snugging reflector trim portions up against a ceiling hole during the simple one motion insertion of the reflector trim assembly into a lamp housing or can. The pull-on clip of the invention deflects on insertion into the interior of a can to hold the reflector trim assembly within the interior of the can by the spring force exerted by the clips attached to said trim.

Accordingly, it is an object of the present invention to provide a reflector trim assembly including associated structure and which has pull-on clips manually mountable thereto without the use of tools and in a job-site environment so that the reflector trim assembly can be inserted into a lamp housing or can in but a single motion with the pull-on clips acting to retain the reflector trim assembly within the can with positive positioning of lamping carried by the assembly and positive engagement of annular flange-like lower portions of the reflector trim assembly to a ceiling hole above which a downlighting fixture "rough-in" is mounted.

It is another object of the invention to provide a mechanically simple and inexpensive pull-on clip which can be assembled to a reflector trim on a job site without the use of tools, thereby allowing operational economies in manufacture, product shipment and job-site installation.

It is a further object of the invention to provide an inexpensive pull-on clip for retaining a reflector trim assembly within the interior of a lamp housing or can of a downlight fixture "rough-in", the clip being locked in place on a reflector trim by a simple and rapid pull-on motion of the clip relative to the trim to lock the clip in place on said trim.

Further objects and advantages of the invention will become more readily apparent in light of the following detailed description of the preferred embodiments.

DESCRIPTION OF THE PREFERRED EMBODIMENTS

Co-pending U.S. patent application Ser. No. 08/686,669, filed Jul. 26, 1996, entitled "Universal Type IC/Non-Type IC Recessed Downlight Housing Can Assembly and Method for Marking the Can Assembly," and assigned to the assignee of the present application, is incorporated hereinto by reference, the patent application describing a lamp housing or can such as is useful with the present invention to form a downlighting fixture. U.S. patent application Ser. No. 08/642,313, filed May 3, 1996, entitled "Thermoplastic Pan Assembly for Mounting Recessed Lighting Fixtures in Ceilings and the Like" and assigned to the assignee of the present patent application is co-pending and incorporated hereinto by reference, this patent application disclosing a mounting or pan structure used as a portion of a downlighting fixture such as is usable with the present invention. Co-pending U.S. patent application Ser. No. 08/610,431, filed Mar. 4, 1996, entitled "Wire Frame Pan Assembly for Mounting Recessed Lighting in Ceilings and the Like" and assigned to the assignee of the present patent application, is incorporated hereinto by reference, this patent application disclosing a mounting or pan structure useful in the formation of a lighting fixture such as can include the structure of the present invention. The disclosures of the aforementioned co-pending United States patent applications are incorporated hereinto by reference.

Figure 2:
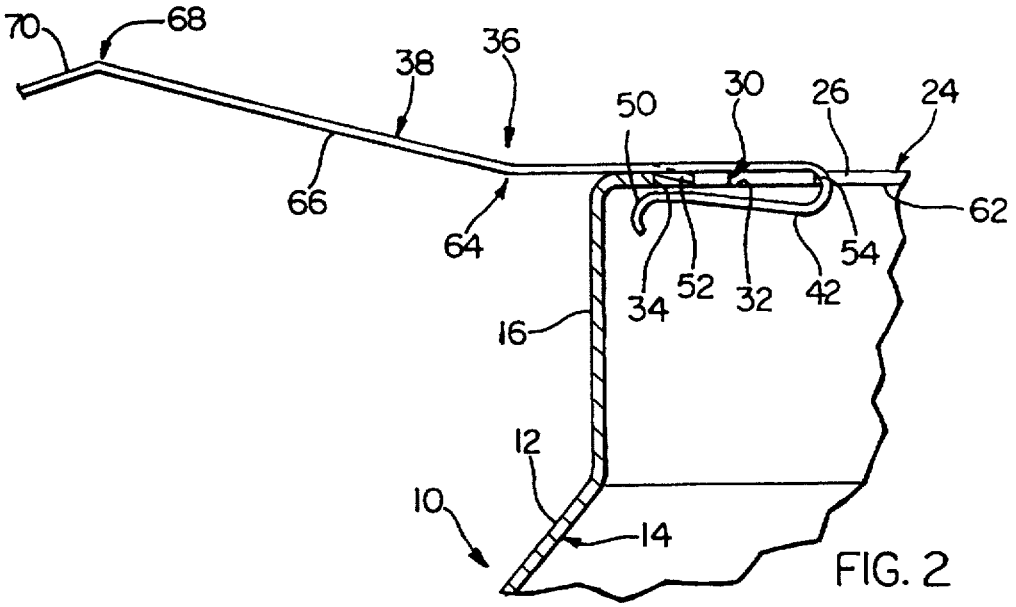
FIG. 2 is a detail sectional view of a portion of the clip of FIG. 1 assembled to the reflector trim.
Figure 1:
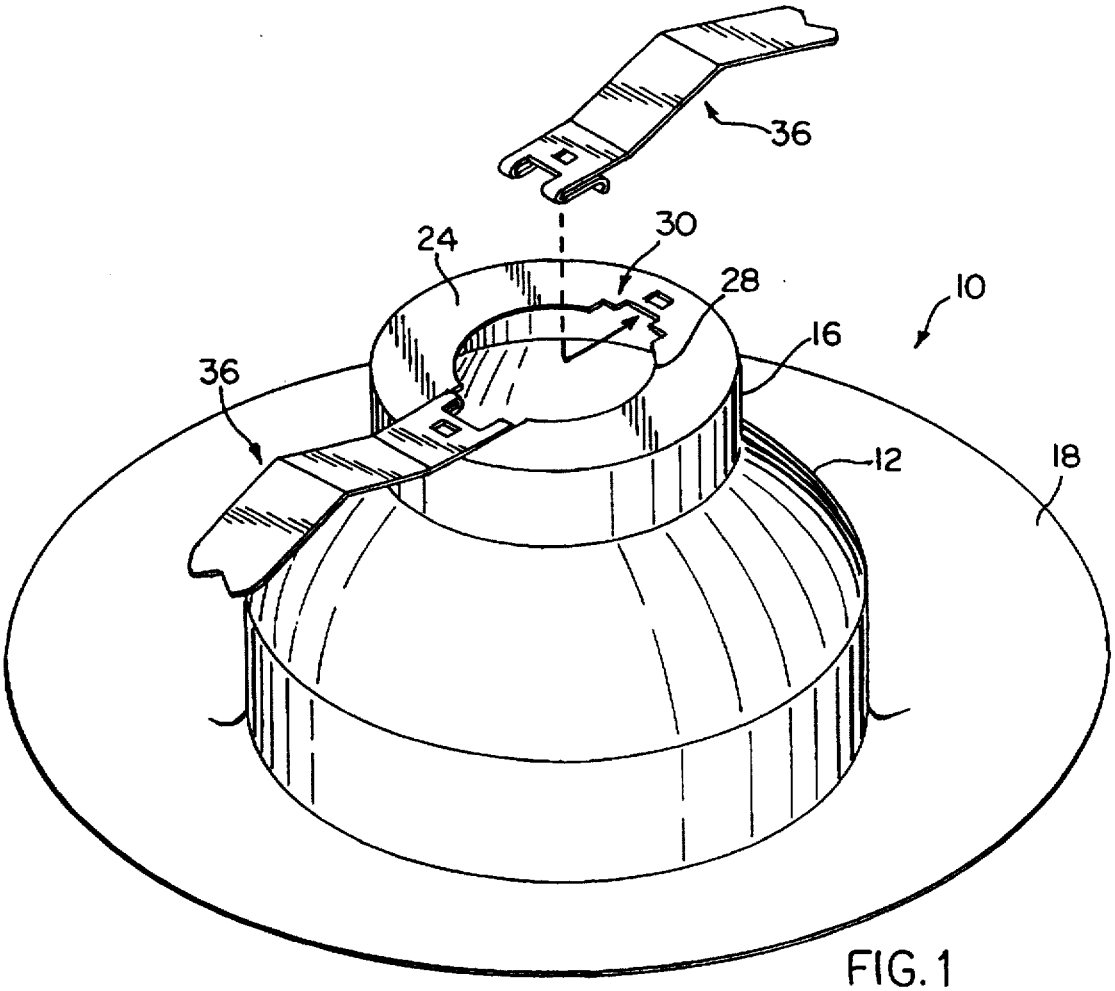
FIG. 1 is a perspective view of a reflector trim and the pull-on clips of the invention, one of the clips being assembled to the reflector trim and the other clip being shown in an assembly relation thereto.
Figure 3A:
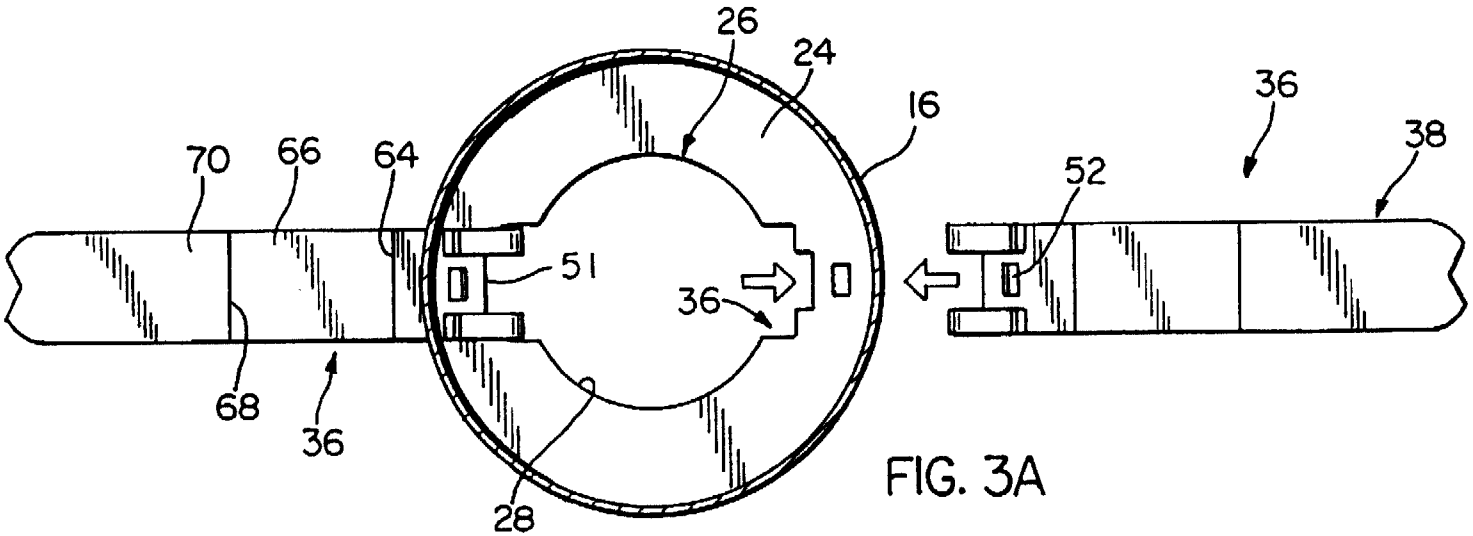
FIG. 3A is a sectional view of an upper portion of the reflector trim taken from a point interiorly thereof and showing one of the pull-on clips assembled thereto and a second clip in an assembly relationship.
Figure 3B:
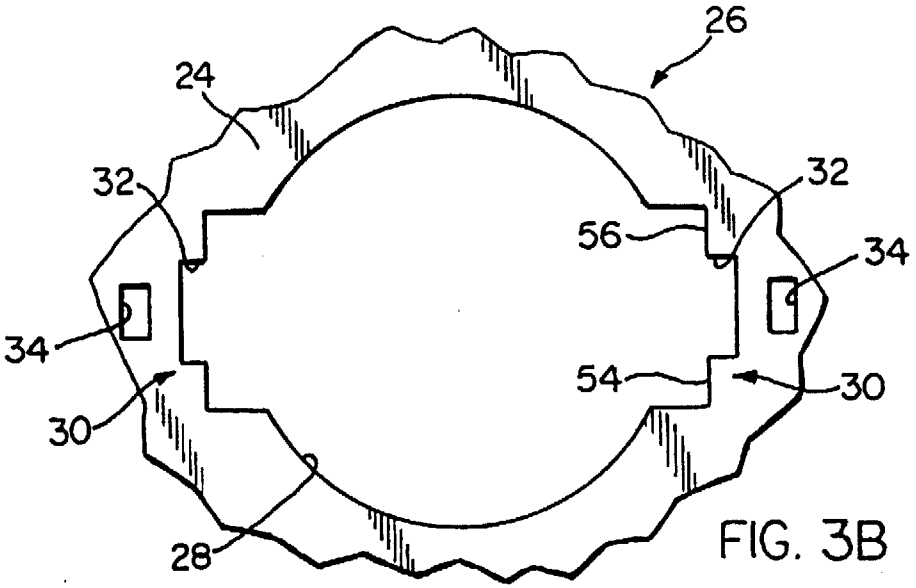
FIG. 3B is a detail view of the opening formed in the top of the reflector trim.

Referring now to the drawings and particularly to FIGS. 1 through 3, a reflector trim is seen at 10, the trim 10 being essentially identical in most respects to conventional reflector trim used in optical assemblies of conventional downlighting fixtures. The reflector trim 10 essentially comprises what is known in the art to be a full optical reflector which optimizes lamp performance. Structure such as the reflector trim 10 can be formed in a variety of shapes and sizes and can be spun or drawn from materials including anodized aluminum or other aluminum alloys, steel and the like. Trims such as the reflector trim 10 can be painted with high reflectivity coatings such as white polyester powder paint which is durable and easily cleanable. Trim such as the reflector trim 10 can be utilized with inexpensive "A" lamps, R-lamps, par lamps, halogen par lamps or other lamping as appropriate. Trim such as the reflector trim 10 is also available in various colors and finishes as is commonplace in the industry.

The reflector trim 10 is seen to comprise a bulbous body portion 12 having interior surfaces 14 which are highly reflective and which define a reflective cavity which optimizes lamp performance. It is to be understood that the body portion 12 can be shaped other than as explicitly shown in the drawings and described herein without departing from the scope of the invention. The body portion 12 is seen to be terminated at the top of the trim 10 by means of a cylindrical cap 16 which is preferably integrally formed with the body portion 12 as is depending flange-like skirt 18 which terminates the body portion 12 about opening 20. The skirt 18 can be formed of a substantially planar annular flange but is preferably formed in a dished-out fashion as is seen in the drawings in order that periphery 22 of the skirt 18 can effectively provide one annular edge which provides the sole loci of points which contact ceiling surfaces as will be shown and described hereinafter.

Planar penultimate surface 24 of the trim 10 is formed with an opening 26 centrally disposed within the circular surface 24, the opening 26 having a circular central portion 28 bordered on diametrically opposed sides of the opening 26 by T-shaped notch portions 30. The opening 26 is shown in detail in FIG. 3B. Leg portions 32 of each of the notch portions 30 extend outwardly of the central portion 28, the notch portions 30 communicating with the central portion 28 of the opening 26 at top portions of the T-shaped notch portions 30. The opening 26 thus takes the form of a circular aperture having T-shaped projections formed in diametrically opposed relation to each other. Immediately outwardly of the leg portions 32 of each of the notch portions 30 is formed a rectangular slot 34. The opening 26 and the slots 34 are conveniently and conventionally punched into the surface 24.

As is further seen in FIGS. 1 through 3A, pull-on clips 36 mount to the reflector trim 10 by reception into the T-shaped notch portions 30 and the rectangular slot 34, each one of the clips 36 mounting to a combination of one of the notch portions 30 and one of the rectangular slots 34 which portions 30 and slot 34 are located in adjacent relation to each other. A total of two of the pull-on clips 36 are used in the embodiment of the invention shown in FIGS. 1 through 3A for a given reflector trim 10 having the opening 26 configured as described. It is to be understood that the opening 26 could be otherwise configured, such as by having a greater number of the T-shaped notch portions 30 formed about the periphery of the circular central portion 28 of the opening 26. Such notch portions would preferably be regularly disposed about the central portion 28 of the opening 26 with three or four clips 36 being suitable for use. However, the preferred embodiment as shown utilizes two of the clips 36 arranged in diametrically disposed relationship to each other across the circular central portion 28 of the opening 26.

Figure 5:
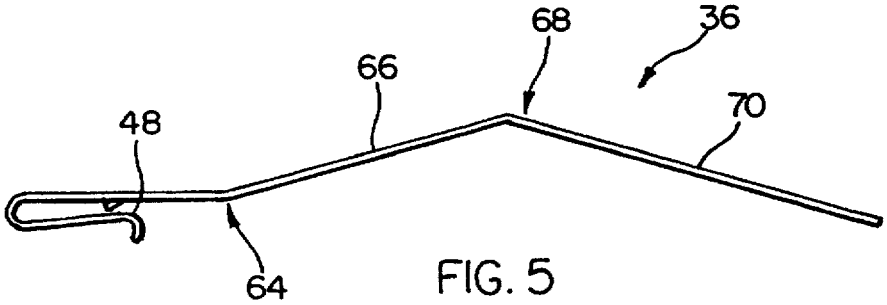
FIG. 5 is a side elevational view of the pull-on clip of FIG. 4.
Figure 4:
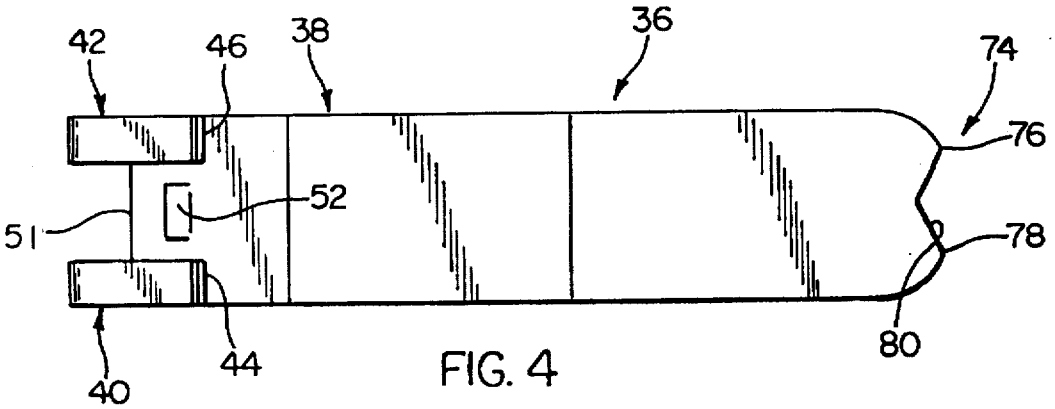
FIG. 4 is a plan view of the pull-on clip.

Referring also to FIGS. 4 and 5 in addition to continuing reference to FIGS. 1 through 3B, the structure of the pull-on clip 36 can be appreciated as well as the mounting thereof to the reflector trim 10. The pull-on clip 36 is seen to be formed of a single length of spring steel such as C-1050 steel of a thickness of 0.020 inch as an example. The grain direction of the spring steel is preferably along the longitudinal axis of the clip 36. The material forming the clip 36 preferably has a Rockwell hardness of Rc 41–46. The clip 36 comprises a body portion 38 formed of a flat length of spring steel stock prior to forming of the clip 36, the body portion 38 being formed at one end to have bent clipping elements 40 and 42 formed along either side of said end, the elements 40 and 42 being essentially identical in structure and being formed of recurved lateral portions of the clip 36 and terminating in arcuate distal tips 44 and 46, the clipping elements 40 and 42 being bent to a radius which causes arcuate pressure surfaces 48 and 50 to be respectively formed immediately anteriorly of said tips 44, 46 on respective clipping elements 40, 42. The body portion 38 of the clip 36 terminates essentially medially of the length of the clipping elements 40, 42, said elements 40, 42 extending beyond the effective end 51 of the clip 36. A locking tab 52 is formed in the body portion 38 of the clip 36 at a location between the tips 44, 46 and spaced from the end of the body portion 38. The locking tab 52 is preferably punched from the material of the body portion 38 in a downward direction toward the tips 44, 46. The locking tab 52 is substantially rectangular in conformation with a length slightly less than the length of the rectangular slot 34 at each end of the surface 24 of the trim 10 such that the locking tab 52 passes over that portion of the surface 24 lying between the opening 26 and the rectangular slot 34 when the clip 36 is engaged within the opening 26 as shown particularly in FIGS. 1 and 3, the locking tab 52 snap-fitting into the rectangular slot 34 as the clip 36 is pulled into place within the T-shaped notch portion 30 of the opening 26. As the clip 36 is attached to the reflector trim 10 to engage the locking tab 52 within the rectangular slot 34, the clipping elements 40 and 42 respectively receive portions of the surface 24 bordering and defining shoulders 54, 56 respectively. The shoulders 54, 56 contact distal interior surfaces of the clipping elements 44, 46 with the arcuate pressure surfaces 48, 50 resiliently biasing up against interior wall 62 disposed about the opening 26 interiorly of the cylindrical cap 16. The clipping elements 40, 42 thus effectively engage and hold to portions of the reflector trim 10 as shown and described while at the same time the locking tab 52 is received into and engages in locking fashion within the rectangular slot 34. Once the clip 36 is so engaged, the clip 36 can only be removed by an intentional deformation of the body of the clip 36 to disengage the locking tab 52 from the rectangular slot 34.

As is best seen in FIGS. 1, 2 and 5, the body portion 38 of the clip 36 bends substantially upwardly at 64 at a preferred angle of approximately 15° to form spring section 66 which then bends downwardly at 68 to form distal section 70, the angle of the distal section 70 to horizontal preferably being approximately 16°. The length of the spring section 66 is greater than the extended lengths of the clipping elements 40, 42 and anterior flat section 72 of the clip 36. The spring section 66 would have a length approximately 25% greater than the length of the portion of the clip 36 disposed anteriorly of the bend at 64. The distal section 70 of the clip 36 would have a length approximately 30 to 35 per cent greater than the length of the distal section 66, these relative lengths being otherwise dimensioned as desired but being preferred in order to accomplish intended results. The distal section 70 is provided with a bifurcated end portion 74 at which outer edges of the body portion 38 round to points 76 and 78 and then terminate in a V-shaped notch 80. The points 76, 78 provide effective contact with structure within which the reflector trim 10 is received as will be described hereinafter. Those portions of the clip 36 formed by bending of the body portion 38 at 64 and at 68 to form the spring section 66 and distal section 70 respectively function to facilitate a "snugging up" of the skirt 18 of the reflector trim 10 against ceiling surfaces as will also be described hereinafter.

Figure 7:
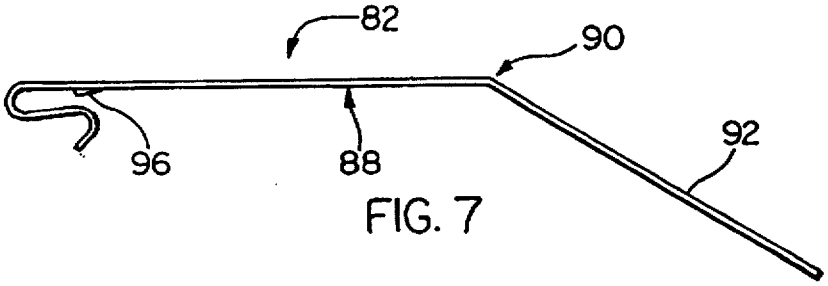
FIG. 7 is a side elevational view of the pull-on clip of FIG. 6.
Figure 6:
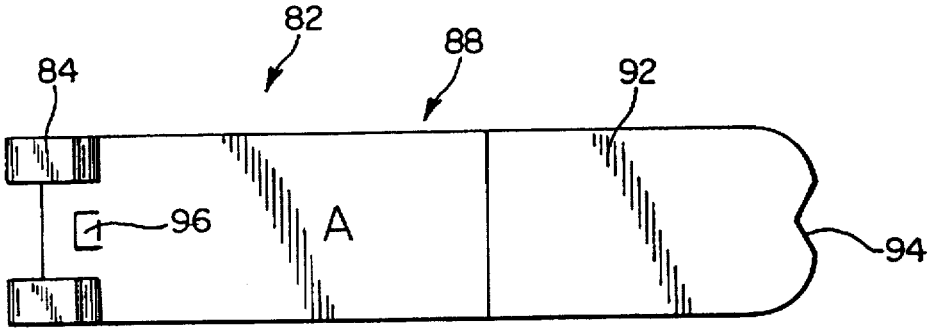
FIG. 6 is a plan view of another embodiment of the pull-on clip of the invention.

A second embodiment of the invention is seen in FIGS. 6 and 7 to form pull-on clip 82 which is similar in structure to the clip 36 but with clipping elements 84, 86 which are of slightly lesser length and with body portion 88 of the clip 82 bending only at 90 to form distal section 92. The distal end of the section 92 is essentially identical to that of the distal section 70 of the clip 36 except in the relative dimensions of portions thereof. As an example, the depth of V-shaped notch 94 in the clip 82 is less than the corresponding notch 80 in the clip 36. Similarly, the notch 94 is more narrow than the notch 80. Locking tab 96 of the clip 82 is essentially identical to the locking tab 52 of the clip 36, the tab 96 having a relief of approximately 0.02 inch which is a suitable relief dimension for the locking tab 52. The relative dimensions of the clips 36 and 82 can effectively be taken from the drawings thereof since these drawings are formed to preferred dimensions for the respective clips.

Figure 8:
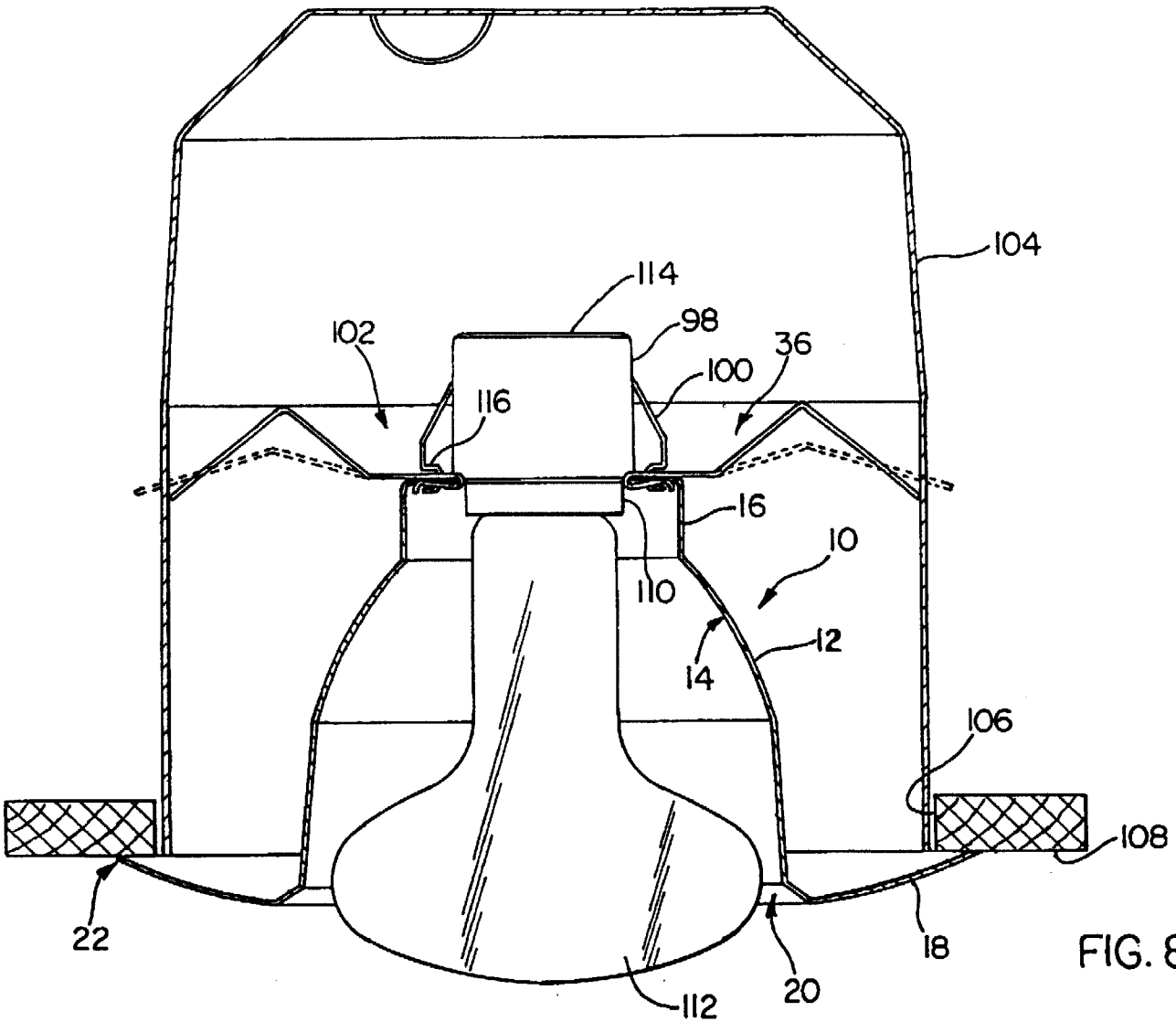
FIG. 8 is a side elevational view in section of an installed lamp housing and reflector trim and lamp socket assembly according to the invention.

Referring now to FIG. 8, the reflector trim 10 having two of the clips 36 attach thereto as aforesaid is seen to further have a lamp socket 98 of conventional structure attached to said trim 10 by means of socket spring clips 100, the clips 100 also being of conventional structure. Attachment of the lamp socket 98 to the reflector trim 10 effectively forms a trim and socket assembly 102 which is received within lamp housing 104, the lamp housing 104 also being typically referred to in the industry as a "can", said housing 104 conveniently being that LC./non-LC. can disclosed in U.S. patent application Ser. No. 08/686,669, referred to hereinabove. The lamp housing 104 is shown for ease of illustration without attachment to a pan structure such trim 10. The spring clips 100 are also formed of spring steel which provides a spring-like resiliency which causes the tabs 116 to be forced outwardly and to therefore effectively mount the lamp socket 98 to the reflector trim 10.

As can be envisioned from a consideration of FIG. 8, a gap can potentially exist between the ceiling 108 and the periphery 22 of the skirt 18 which forms the lowermost part of the reflector trim 10. Such a gap can occur when the trim and socket assembly 102 is not positively held in place within the confines of the lamp housing 104. The existence of such a gap is unsightly and must be eliminated in order to provide a desirable appearance. The formation of the spring section 66 in bent relation to anterior portions of the clip 36 and also in bent relationship to the distal section 70 of said clip 36 causes exertion of an inwardly directed force which essentially "snugs up" the assembly 102 into the lamp housing 104 so that the periphery 22 of the skirt 18 flushly contacts the ceiling 108 about the opening 106. The reflector trim 10 not only accomplishes its reflecting function but also its trimming function by virtue of the operation of the clips 36. The points 76, 78 at the distal end of the clip 36 serve to engage inner wall surfaces of the lamp housing 104 to further contribute to a correct location of the trim and socket assembly 102 within the lamp housing 104.

The structure thus described is seen to provide the advantages referred to hereinabove. In particular, the clips 36 themselves can be inexpensively manufactured and are not intended to be assembled to a reflector trim such as the trim 10 in the manufacturing environment. Accordingly, a number of the reflector trims 10 can be nested together and compactly as the pan structures disclosed in co-pending U.S. patent applications Ser. No. 08/642,313 and Ser. No. 08/610,431 referred to hereinabove. It is to be understood that other lamp housings and pan assemblies can be utilized without departing from the scope of the invention. The lamp housing 104 is seen to fit within opening 106 in ceiling 108, lower portions of the lamp housing 104 extending into the opening 106. The trim and socket assembly 102 can be inserted in essentially a single motion into the interior of the lamp housing 104, the pull-on clips 36 deforming from the positions shown in phantom to the assembled positions shown in FIG. 8. It is to be understood that the showing of the clips 36 in phantom would be those positions of the clips 36 prior to insertion of the assembly 102 into the lamp housing 104. It is also to be understood that the lamp socket 98 carries electrical wiring (not shown) which extends through the lamp housing 104 to a J-box (not shown) as is conventional in the art. The lamp socket 98 mounts to surface 24 of the trim 10 with a reduced-in-diameter cylindrical portion 110 of said socket 98 being received into the opening 26 of the cap 16 and particularly into the circular central portion 28 of the opening 26 to facilitate mounting of lamp 112 for receiving electrical power as is shown in FIG. 8. The lamp socket 98 conventionally mounts the clips 100 which can be formed of a single piece of material having a central strap portion seen at 114 on the socket 98. The clips 100 terminate in recurved arcuate tabs 116 which fit into respective leg portions 32 of the opening 26 formed in the trim 10, the tabs 116 lying between the clipping elements 40, 42 of the respective clips 36 attached to the packaged for shipment to a job site at which location the clips 36 can be quickly and easily pulled onto each of the reflector trims 10 without the need for tools. The embodiments of the pull-on clip of the invention shown and described herein function to provide substantial advantages in the art especially in combination with a reflector trim assembly comprising a reflector trim such as the reflector trim 10 and pull-on clips such as the clips 36. Further, the invention provides substantial advantages to the operation and use of an assembly such as the trim and socket assembly 102 which also utilizes pull-on clips such as the clips 36. It is therefore to be noted that the invention can be embodied other than as explicitly illustrated and described herein without departing from the scope of the invention, the inventive scope being defined by the recitations of the appended claims.

What is claimed is:

1. A clip for mounting a reflector trim within a lamp housing of a lighting fixture mounted above a ceiling opening formed in a ceiling, the reflector trim having a reflector trim opening formed in one end thereof to receive a portion of a lamp socket, the reflector trim opening communicating with notches formed about the periphery of the opening in the trim, the trim further having a slot formed in juxtaposition to each of the notches, the clip comprising:

an anterior end portion having a locking tab formed therein, the locking tab engaging and being received into one of the slots when the anterior end portion of the clip is pulled over one of the notches; and, at least one clipping element formed in the anterior end portion of the clip and being recurved distally to receive and bias against edge portions of the trim defining the notches to facilitate mounting of the clip to the trim.

2. The clip of claim 1 wherein body portions of the clip are formed of a single piece of spring steel stock.

3. The clip of claim 1 and further comprising:

a medial portion of the clip formed at an angle to the anterior end portion of the clip; and, a distal portion of the clip formed at an angle to the medial portion of the clip, the medial and distal portions of the clip acting on engagement with interior walls of the lamp housing to pull the reflector trim and lamp socket mounted thereto inwardly of the lamp housing to fit the trim snugly against the ceiling about the ceiling opening.

4. The clip of claim 3 wherein end portions of the distal portion of the clip are formed into spaced points for engagement with interior walls of the lamp housing.

5. The clip of claim 3 wherein body portions of the clip are formed of a single piece of spring steel stock.

6. The clip of claim 1 wherein distal end portions of the clip are formed into spaced points for engagement with interior walls of the lamp housing.

7. The clip of claim 1 wherein a body portion of the locking tab is formed out of plane with the anterior end portion of the clip and extends from a side of the clip along which the at least one clipping element recurves.

8. The clip of claim 1 and further comprising:

a distal portion of the clip formed at an angle to the anterior end portion of the clip.

9. The clip of claim 8 wherein end portions of the distal portion of the clip are formed into spaced points for engagement with interior walls of the lamp housing.

10. The clip of claim 8 wherein body portions of the clip are formed of a single piece of spring steel stock.

11. A clip for mounting a reflector trim within a lamp housing of a lighting fixture, the reflector trim having an opening formed in one end thereof to receive a portion of a lamp socket, the reflector trim having at least one slot formed therein and spaced from the opening, the clip comprising:

a body element having first and second end portions;

locking means formed in a first end of the body element for engaging the at least one slot when the first end is pulled over a perimetric portion of the opening from which the at least one slot is spaced; and, clipping means formed in the first end portion of the body element for receiving and biasing against edge portions of the perimetric portion of the opening from which the at least one slot is spaced to facilitate mounting of the clip to the trim.

12. The clip of claim 11 wherein the body element is formed of a single piece of spring steel stock.

13. The clip of claim 11 wherein the body element comprises:

a medial portion formed at an angle to the first end portion of the clip; and, a distal portion of the clip comprising the second end of the body element and being formed at an angle to the medial portion of the clip, the medial and distal portions of the clip acting on engagement with interior walls of the lamp housing to pull the reflector trim and lamp socket mounted thereto inwardly of the lamp housing to fit the trim snugly against the juxtaposed building structure above which the lighting fixture is mounted.

14. The clip of claim 11 wherein the locking means comprise a locking tab formed in the body element, the locking tab engaging and being received into the at least one slot.

15. The clip of claim 11 wherein the clipping means comprise at least one clipping element which is recurved distally to receive and bias against edge portions of the perimetric portion of the opening from which the at least one slot is spaced to facilitate mounting of the clip to the trim.

16. The clip of claim 15 wherein the locking means comprise a locking tab formed in the body element, the locking tab engaging and being received into the at least one slot.

17. The clip of claim 16 wherein a body portion of the locking tab is formed out of plane with the first end portion of the clip and extends from a side of the clip along which the at least one clipping element recurves.

18. The clip of claim 11 wherein a distal portion of the body element comprising the second end portion thereof is formed at an angle to the first end portion of the body element.

19. The clip of claim 18 wherein end portions of the distal portion of the clip are formed into spaced points for engagement with interior walls of the lamp housing.

20. The clip of claim 11 wherein the reflector trim has a plurality of slots formed therein and spaced from the opening, one each of the clips engaging one each of the slots.

* * * * *